US010617580B2

(12) United States Patent
Steiner

(10) Patent No.: US 10,617,580 B2
(45) Date of Patent: Apr. 14, 2020

(54) WHEELCHAIR WITH RATCHET/PAWL DRIVE SYSTEM

(71) Applicant: Gerald M. Steiner, Pahrump, NV (US)

(72) Inventor: Gerald M. Steiner, Pahrump, NV (US)

( * ) Notice: Subject to any disclaimer, the term of this patent is extended or adjusted under 35 U.S.C. 154(b) by 0 days.

(21) Appl. No.: 16/278,285

(22) Filed: Feb. 18, 2019

(65) Prior Publication Data

US 2020/0022855 A1 Jan. 23, 2020

Related U.S. Application Data

(60) Provisional application No. 62/699,428, filed on Jul. 17, 2018.

(51) Int. Cl.
*A61G 5/10* (2006.01)
*A61G 5/02* (2006.01)

(52) U.S. Cl.
CPC ..... *A61G 5/1024* (2013.01); *A61G 5/025* (2013.01); *A61G 5/1016* (2013.01)

(58) Field of Classification Search
CPC ..... A61G 5/1024; A61G 5/025; A61G 5/1016
USPC ..... 280/249
See application file for complete search history.

(56) References Cited

U.S. PATENT DOCUMENTS

| | | | | |
|---|---|---|---|---|
| 4,865,344 | A | 9/1989 | Romero, Sr. et al. | |
| 5,263,729 | A * | 11/1993 | Watwood | A61G 5/022 280/246 |
| 5,746,437 | A | 5/1998 | Faber | |
| 6,371,502 | B1 * | 4/2002 | Howlett | A61G 5/022 188/2 F |
| 6,731,502 | B1 | 5/2004 | Hsu | |
| 7,520,519 | B2 | 4/2009 | Smurthwaite, Jr. | |
| 8,152,188 | B2 | 4/2012 | Kylstra | |

FOREIGN PATENT DOCUMENTS

| | | | |
|---|---|---|---|
| WO | WO-8503265 A1 * | 8/1985 | A61G 5/023 |

* cited by examiner

*Primary Examiner* — Jacob D Knutson
*Assistant Examiner* — Felicia L. Brittman
(74) *Attorney, Agent, or Firm* — The Thornton Firm, LLC; Scott D. Thornton

(57) ABSTRACT

A wheelchair with a ratchet/pawl drive system comprising a seat back, a seat bottom, a frame, two mounting brackets, two car guide tracks, two front wheel assemblies, two car assemblies, two brake assemblies, two drive wheels, and two wheelchair wheels. The ratchet/pawl drive comprises at least one drive wheel sprocket, at least one ratchet/pawl assembly, at least one forward-neutral-reverse lever and at least one brake assembly. The ratcheting/pawl drive system may be included in a novel wheelchair or may be integrated into existing standard wheelchairs as a retrofit kit.

20 Claims, 16 Drawing Sheets

WHEELCHAIR WITH RATCHET/PAWL DRIVE SYSTEM

CROSS-REFERENCE TO RELATED APPLICATIONS

The present utility patent application claims priority benefit of the U.S. provisional application for patent Ser. No. 62/699,428 titled "Ratcheting Drive for Wheelchairs," filed on Jul. 17, 2018 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

BACKGROUND OF THE INVENTION

1. Field of the Invention

One or more embodiments of the invention generally relate to wheelchairs. More particularly, embodiments of the invention relate to a wheelchair with a ratchet/pawl drive system and curb climber for wheelchairs for standard, self-propelled wheelchairs.

2. Description of the Related Art

Standard wheelchairs are well known and understood in the art. A standard, self-propelled manual wheelchair typically incorporates a frame, a seat, a footrest assembly including one or two footplates (footrests), two swivel caster wheels at the front, and two large wheels at the back. The two large wheels at the back may resemble a bicycle wheel in that they have a hub assembly and spokes radiating from the hub assembly to the rim. A tire is generally affixed to the rim. In contrast to a bicycle wheel, though, the larger rear wheels usually have push-rims of slightly smaller diameter mounted to the rear wheels and projecting just beyond the tire. The push rims allow the user to maneuver the chair by pushing on them without requiring them to grasp the tires. Standard wheelchairs often have two push handles at the upper rear of the frame to allow for manual propulsion by a second person.

In a standard wheelchair, a user revolves the rear wheels by applying force to the push rims which are attached to the rear wheels using his or her hands to move the wheel chair. Alternatively, another person may push or pull the wheel chair from the back. Among these, the wheel chair operated by revolving the wheel with hands charges a significant burden to the patient or the user, and it is very difficult to operate on an inclined route. The wheel chair operated by pushing or pulling in the back can be operated only when a guardian or a third person is available. It is also difficult to operate in an inclined route and also is especially burdensome during a turn to the guardian or the third person. Standard wheelchairs generally have brakes that bear on the tires of the rear wheels, however these are, in general, a parking brake where in-motion braking is provided by the user's palms bearing directly on the push-rims. As this causes friction and heat build-up, particularly on long downslopes, many wheelchair users will choose to wear padded wheelchair gloves.

Standard manual wheelchairs come in two major varieties, folding or rigid. Folding chairs are generally low-end designs, whose predominant advantage is being able to fold, generally by bringing the two sides together. However, this is largely an advantage for part-time users who may need to store the wheelchair more often than use it. Rigid wheelchairs, which are increasingly preferred by full-time and active users, have permanently welded joints and many fewer moving parts. This reduces the energy required to push the chair by eliminating many points where the chair would flex and absorb energy as it moves. Welded rather than folding joints also reduce the overall weight of the chair. Rigid chairs typically feature instant-release rear wheels and backrests that fold down flat, allowing the user to dismantle the chair quickly for storage in a car. The wheels of folding chairs may be permanently attached, but those for rigid chairs are commonly fitted with quick-release axles activated by depressing a button or releasing a lever at the hub.

Many rigid models are now made with ultralight materials such as aircraft-grade aluminum and titanium, and wheelchairs of composite materials such as carbon-fiber have started to appear. Ultra-lightweight rigid wheelchairs are commonly known as 'active user chairs' as they are ideally suited to independent use. Another innovation in rigid chair design is the installation of shock absorbers, which cushion the bumps over which the chair rolls. These shock absorbers may be added to the front wheels, to the rear wheels, or both. Rigid chairs also have the option for their rear wheels to have a camber, or tilt, which angles the tops of the wheels in toward the chair. This allows for more mechanically efficient propulsion by the user and also makes it easier to hold a straight line while moving across a slope. Sport wheelchairs often have large camber angles to improve stability.

Rigid-framed chairs can be made to order, suiting both the specific size of the user and their needs and preferences around areas such as the stability around the rear axle. Experienced users with sufficient upper-body strength can generally balance the chair on its rear wheels allowing an independent wheelchair user to climb and descend curbs and move more easily over small obstacles and irregular ground such as cobbles.

All major varieties of wheelchair can be highly customized for the user's needs. Such customization may encompass the seat dimensions, height, seat angle, footplates, leg rests, front caster outriggers, adjustable backrests and controls. Various optional accessories are available, such as anti-tip bars or wheels, safety belts, adjustable backrests, tilt and/or recline features, extra support for limbs or head and neck, holders for crutches, walkers or oxygen tanks, drink holders, and mud and wheel-guards as clothing protectors.

Since a person required to use a wheel chair is most likely one who cannot use the lower half of his or her body, and sometimes who is not in a good physical condition, the amount of work such as operating a wheel chair by revolving the wheels directly with hands over long distances is a severe burden to the user. It has therefore been desirable to equip improved propulsion devices into the wheelchair. Such devices tend to be motors or resemble drive mechanisms used in today's bicycles.

Standard wheelchairs tend to be slow and strenuous for the user. It is also widely known that prolonged usage of a standard wheelchair can cause the user to have raised misshaped (bat-like) shoulders. Furthermore, the rear wheels and push rims have the tendency to become road-filthy. In addition, standard wheelchairs have been shown to cause physical damage to the human body such as shoulder malformation after prolonged use. A wheelchair user's hands frequently become injured and bruised from constant contact with the wheels. Outside use of standard wheelchairs necessitates the wearing of gloves even in the hottest of seasons.

Many wheelchair users who are unable to self-propel a standard manual wheelchair would otherwise require a power chair to meet all of their mobility needs. Being able to self-propel, however, is a much healthier option to resorting to the use of power wheel chairs—which tend to cause further degeneration of the user's general physical capabilities.

Presently, there is a need for an improved wheelchair with an improved drive mechanism which allows the user to more efficiently propel a wheelchair and to obtain higher speed and maneuverability. There also exists a need for a wheelchair retrofit kit which may include an improved drive mechanism. Finally, there exists a need for an improved wheelchair with an enhanced ability to climb curbs and steep inclined planes without getting caught.

SUMMARY

The present invention meets the need for an improved wheelchair with an improved drive mechanism which allows the user to more efficiently propel a wheelchair and to obtain higher speed and maneuverability. Furthermore, embodiments of the present invention provide for a wheelchair retrofit kit which may include an improved drive mechanism. Finally, the present invention offers an improved wheelchair with an enhanced ability to climb curbs and steep inclined planes without getting caught.

The present invention is directed to a wheelchair with a ratcheting drive comprising a seat back, a seat bottom, a frame, two mounting brackets, two car guide tracks, two front wheel assemblies, two car assemblies, two brake assemblies, two drive wheels, and two wheelchair wheels. The ratcheting drive comprises at least one drive wheel sprocket; at least one ratchet/pawl assembly, at least one forward-neutral-reverse lever and at least one brake assembly. The ratcheting/pawl drive may be included a in a novel wheelchair or may be integrated into existing standard wheelchairs as a retrofit kit.

The present invention employs variants of a ratcheting/pawl drive for wheel chairs and is a completely different design of wheelchair in that the user can 'drive' it at an appreciably faster pace, much more comfortably and without expending nearly as much energy. As such, the inventor has referred to it as the Rally Wheelchair. To propel the wheelchair forward with the ratchet/pawl drive, a user simply moves a forward-neutral-reverse lever into the forward position, engages the ratchet/pawl drive with a drive wheel and pushes a set of adjustable handles. The ratcheting action allows a user to push forward on the drive handles to start the forward propulsion. In forward gear pushing the drive handles forward moves the wheelchair forward. To propel the wheelchair backward with the ratchet/pawl drive, a user simply moves a forward-neutral-reverse lever into the reverse position, engages the ratchet/pawl drive with a drive wheel and pulls the set of adjustable handles. The ratcheting action allows a user to pull backwards on the drive handles to start the reverse propulsion. In reverse gear, pulling the drive handles back moves the wheelchair backwards. The drive handles on the forward motion move freely so that the 'rowing' cycle can start over again. Because of the symmetrical nature of the drive system, a user may apply differing degrees of force to each handle of the car assemblies so as to steer the wheelchair.

Such an innovation can make lethargy-causing motorized versions unnecessary. The user of the present invention may readily climb inclines that would not be feasible otherwise. And since a user's hands do not touch the road-filthy wheels to propel the wheel chair, the present invention is more sanitary. Furthermore, the present invention is a safer alternative to standard wheelchairs as the user's hands neither engage with a moving push rim nor become entangled in the wheel spokes which is a common problem with standard wheel chairs.

An added benefit of the positioning and style of the drive handles is that the user will not suffer the all-too-prevalent ligament damage to the hands and shoulders. Such a wheelchair eliminates the probability of such disfigurement. Additionally, because of the positioning and style of the drive handles, the present invention provides the user a greater variety of exercise to the upper arms, chest and intercostal muscles, making for a much healthier lifestyle. Put simply, the Rally Wheelchair aims to create a healthier and more enjoyable wheelchair propulsion system.

The drive system uses a ratchet/pawl system so that the driver may simply flip a knob or switch to go from forward to reverse. The innovative ratchet/pawl drive system is a much safer version of drive systems incorporating chains, belts or sprockets. Furthermore, the present invention may pass through narrower doorways as the need for a wider mounted push rim is eliminated.

It is an object of the present invention to provide a cleaner, less stressful, and more comfortable wheelchair with a much safer braking mechanism.

It is a further object of the present invention to convert the existing push rims of a standard wheelchair into a more efficient drive mechanism.

It is another objective that the present invention may be implemented as a new type of wheelchair or it may be implemented as an aftermarket retrofit kit which may be installed on any standard wheelchair. Implemented as a retrofit kit, the present invention may be installed using the existing frame, wheels, hub and axle of a standard wheelchair. The present invention is designed to be simple in both design and use.

Patients with a very broad range of diagnosis may benefit dramatically from the present invention, including persons suffering the effects of limb amputation, arthritis, ataxia, cerebral palsy, cerebrovascular accident or stroke, congestive heart failure, effects of diabetes, fractures of the femur, hip, pelvis, and/or bilateral lower extremities, hemiplegia, amyotrophic lateral sclerosis (ALS), multiple sclerosis, muscular dystrophy, osteoporosis, paraplegia, post-polio, spina bifida, spinal cord injury, tetraplegia, and or the effects of traumatic brain injury.

BRIEF DESCRIPTION OF THE DRAWINGS

The invention directed by way of example, and not by way of limitation, in the figures of the accompanying drawings and in which like reference numerals refer to similar elements and in which.

Figure 1:
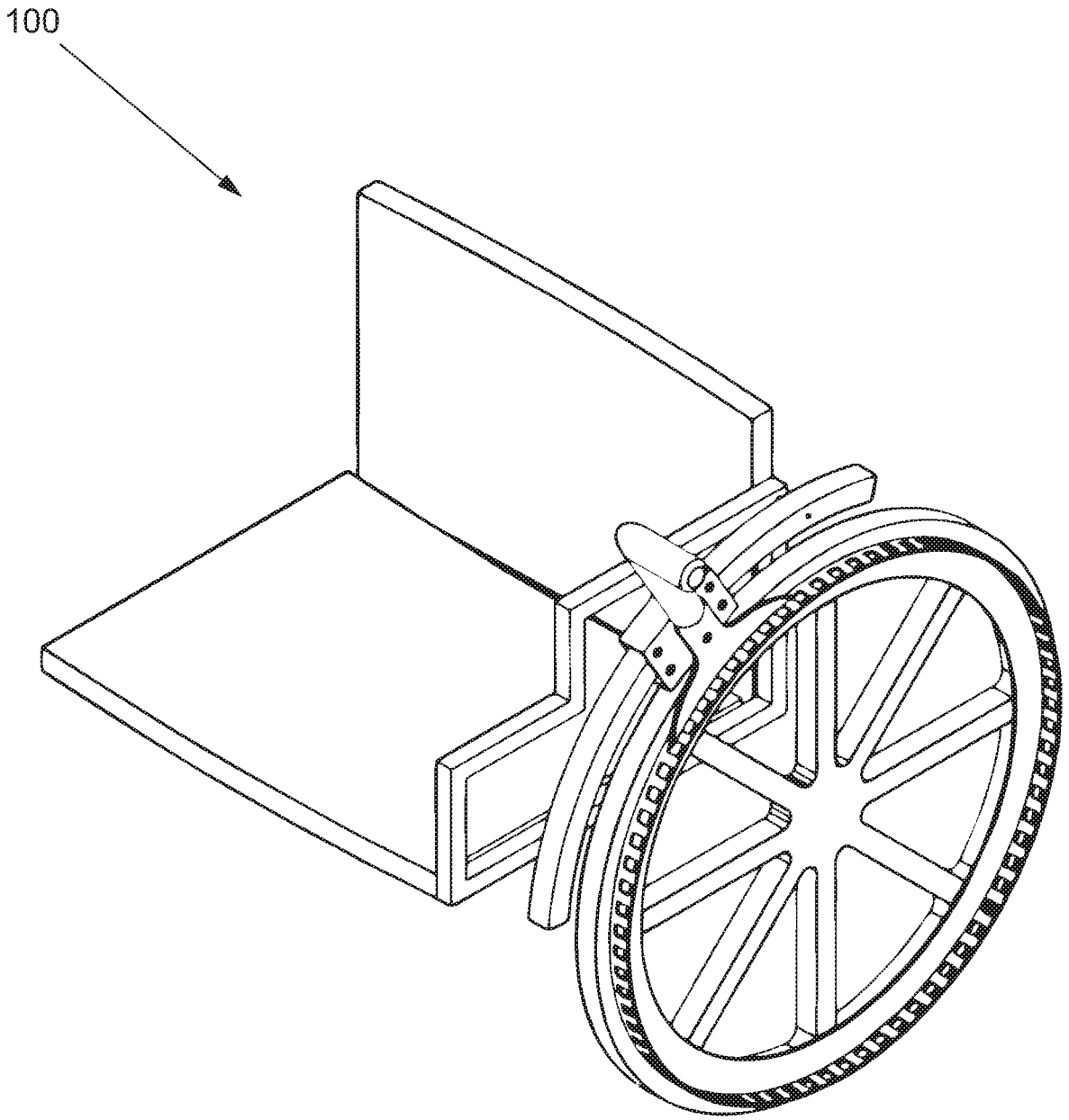
FIG. 1 is a perspective view of the left side of the wheelchair with ratchet/pawl drive system in accordance with an embodiment of the invention.

Unless otherwise indicated illustrations in the figures are not necessarily drawn to scale.

DETAILED DESCRIPTION OF THE PREFERRED EMBODIMENTS

Terminology used herein is used for the purpose of describing particular embodiments only, and is not intended to limit the scope of the present invention. It must be understood that as used herein and in the appended claims, the singular forms "a," "an," and "the" include the plural reference unless the context clearly dictates otherwise. For example, a reference to "an element" is a reference to one or more elements and includes all equivalents known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Language that may be construed to express approximation should be so understood unless the context clearly dictates otherwise.

Unless defined otherwise, all technical and scientific terms used herein have the same meanings as commonly understood by a person of ordinary skill in the art to which this invention belongs. Preferred methods, techniques, devices, and materials are described. But any methods, techniques, devices, or materials similar or equivalent to those described herein may be used in the practice or testing of the present invention. Structures described herein should also be understood to refer to functional equivalents of such structures.

References to "one embodiment," "an embodiment," "various embodiments," etc., may indicate that the embodiment(s) of the invention so described may include particular features, structures, or characteristics. However, not every embodiment necessarily includes the particular features, structures, or characteristics. Further, repeated use of the phrase "in one embodiment," or "in an exemplary embodiment," do not necessarily refer to the same embodiment although they may. A description of an embodiment with several components in communication with each other does not imply that all such components are required. On the contrary, a variety of optional components are described to illustrate the wide variety of possible embodiments of the present invention.

As is well known to those skilled in the art, many careful considerations and compromises typically must be made when designing for the optimal manufacture of a commercial implementation of such a wheelchair with ratchet/pawl drive system. A commercial implementation in accordance with the spirit and teachings of the invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art.

The exemplary wheelchair with ratchet/pawl drive system will now be described in detail with reference to embodiments thereof as illustrated in the accompanying drawings.

FIG. 1 is a perspective view of the left side of the wheelchair with ratchet/pawl drive system 100 in accordance with an embodiment of the invention. In this view, the right side has been hidden for ease of illustration and explanation. Persons skilled in the art will understand that, in this and the following views, that the right-side view may not show components included on the left side, but it is assumed to include components mirroring those on the left. Persons skilled in the art will understand that components known to exist in standard wheelchairs, yet not depicted in this or the following figures are understood to readily integrate with embodiments of the present invention. Additionally, persons having skill in the art will understand that components of the exemplary wheelchair with ratchet/pawl drive system may be used on one side of a wheelchair or both sides depending on user need. Finally, persons skilled in the art will appreciate that the components depicted in this and the following illustrations may be assembled into a new and improved wheelchair or sold as an aftermarket retrofit kit for standard wheelchairs with components and attachment equipment such as, but not limited to instructions and fastening and/or connecting materials included.

Figure 2:
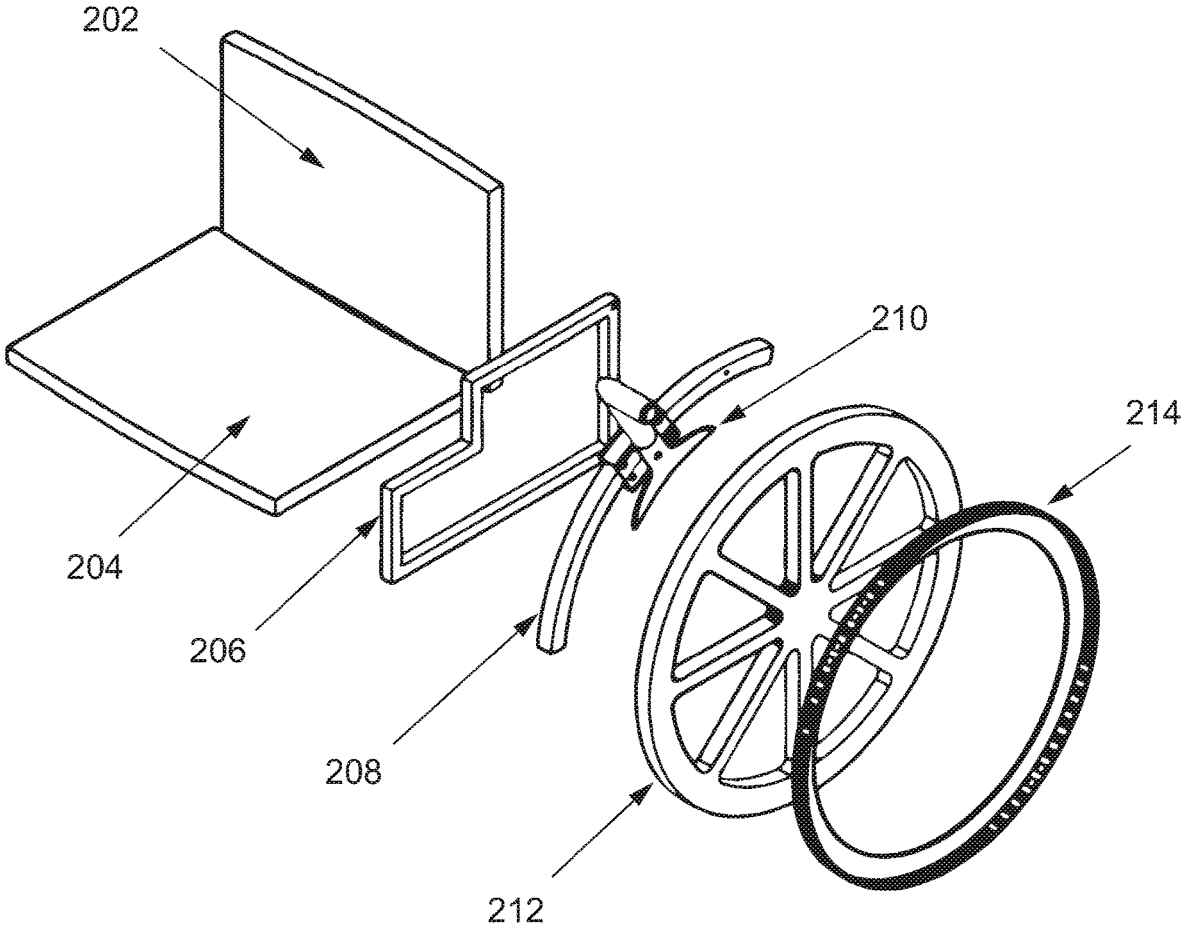
FIG. 2 is a perspective exploded view of the left side of the wheelchair with ratchet/pawl drive system in accordance with an embodiment of the invention.

FIG. 2 is a perspective exploded view of the left side of the wheelchair with ratchet/pawl drive system in accordance with an embodiment of the invention. The forward/neutral/reverse slide shifting system is unique in its basic simplicity. The drive system uses a ratchet/pawl drive system so that the driver may move forward-neutral-reverse lever 105 to go from forward to neutral to reverse. The innovative ratchet/pawl drive system is a much safer version of the old bicycle chain and sprocket mechanism. The present invention, because of the elimination of a push rim, can pass through narrower doorways even though the chair size is exactly the same.

The primary components comprise a seat back 202, seat bottom 204, a mounting bracket 206, a car guide track 208, a car assembly 210, a rear chair wheel 212, and a drive wheel 214. The left rear chair wheel 212 as shown may movably connect to a right rear chair wheel (not shown) by means known by those skilled in the art such as, but not limited to, a wheelchair axle or axle assembly. Alternatively, the left rear chair wheel 212 may movably connect to the mounting bracket 206.

In embodiments of the present invention, the mounting bracket 206 may rigidly attach to the seat back 202 and seat bottom 204. Persons skilled in the art will understand that such attachment means may include, but is not limited to, welds, bolts, screws, rivets or pins. The ratchet/pawl and brake assembly's car guide track 208 may rigidly attach to the mounting bracket or may be integrated into the mounting bracket 206.

Figure 3:
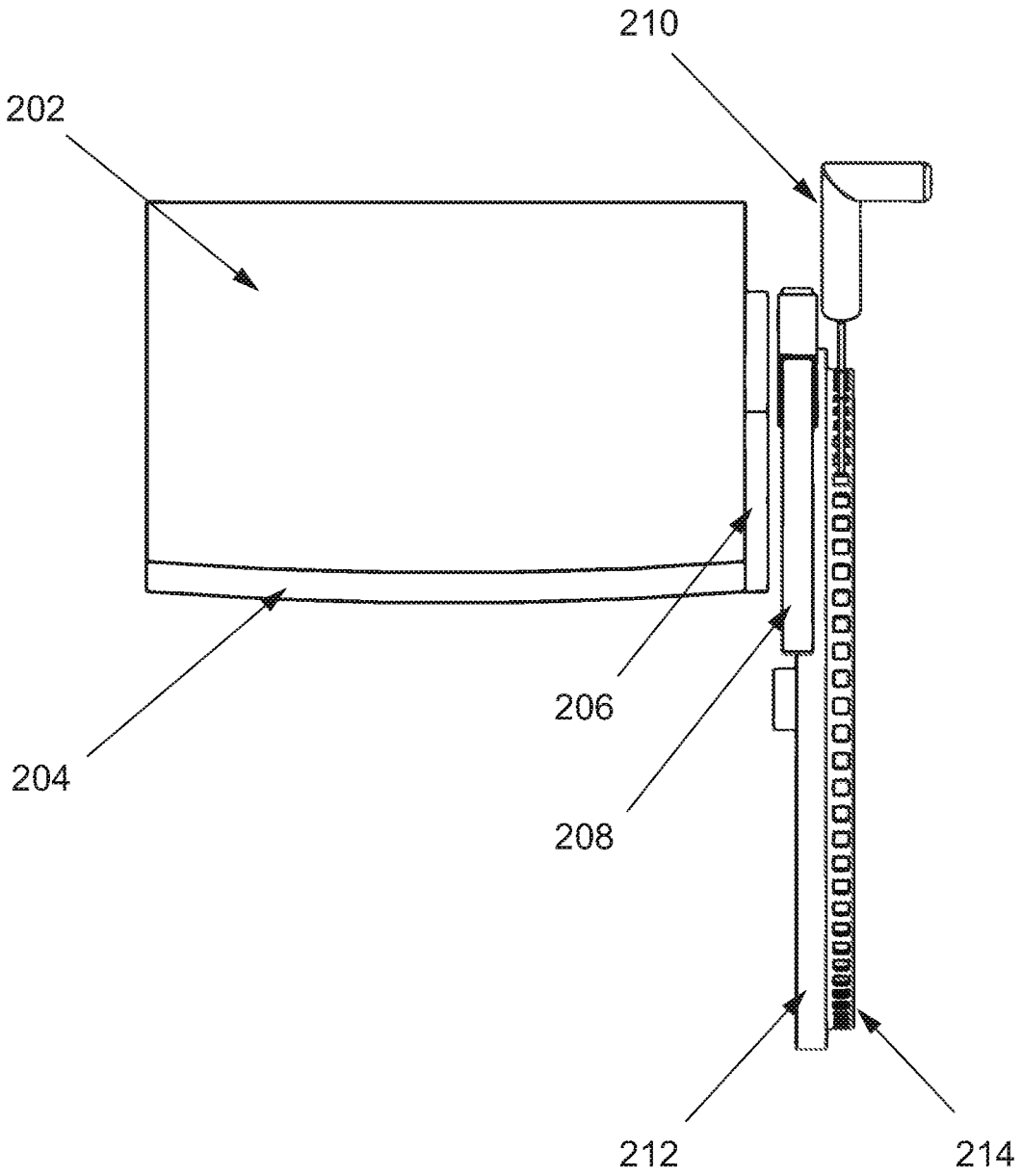
FIG. 3 is a front view of the left side of a wheelchair with ratchet/pawl drive system in accordance with an embodiment of the invention.

FIG. 3 is a front view of the left side of the wheelchair with ratchet/pawl drive system in accordance with an embodiment of the invention. In some embodiments of the invention, each mounting bracket 206 may attach to a wheelchair frame on opposite sides where the seat back 202 and seat bottom 604 connect. In other embodiments, the mounting bracket 206 may serve as part of the frame itself. Persons skilled in the art will understand that each mounting bracket 206 may attach by known means such as, but not limited to, standard bolts or welding. The mounting brackets 206 may serve to provide additional rigidity and stability for a wheelchair frame. The ratchet/pawl and brake assembly's car guide track 208 may rigidly attach to the mounting bracket 206 or may be integrated into the mounting bracket 206 to form a single unit. Each mounting bracket 206 is capable of accommodating the car assembly 210. Persons skilled in the art will appreciate that the mounting brackets 206 may be fabricated from numerous materials such as, but not limited to, metals and plastics. The mounting brackets 206 may assume different shapes and confirmations so as to easily integrate with various wheelchair frames known and appreciated in the art. Persons having skill in the art will readily appreciate that the mounting frame 606 may connect to the frame and seat components of a standard wheelchair by standard means such as, but not limited to, screws, rivets bolts, and/or welds.

In this view, the car assembly 210 is movably connected and/or engaged with a drive wheel 214 which covers the perimeter of a drive wheel which may be connected to a wheelchair wheel 212 by numerous means known and appreciated in the art. The drive wheel 214 may be a semi-solid wheel with dual opposing 'drop-door' pawl slots to which the ratchet/pawl and brake assembly may engage. In embodiments of the invention, the drive wheel 214 is attached to the wheelchair wheel 212 so as to create a single axis of rotation, the axis of which may be used to create a hub/axle which may rotatably connect to a standard wheelchair frame or to the mounting bracket 206.

Figure 4:
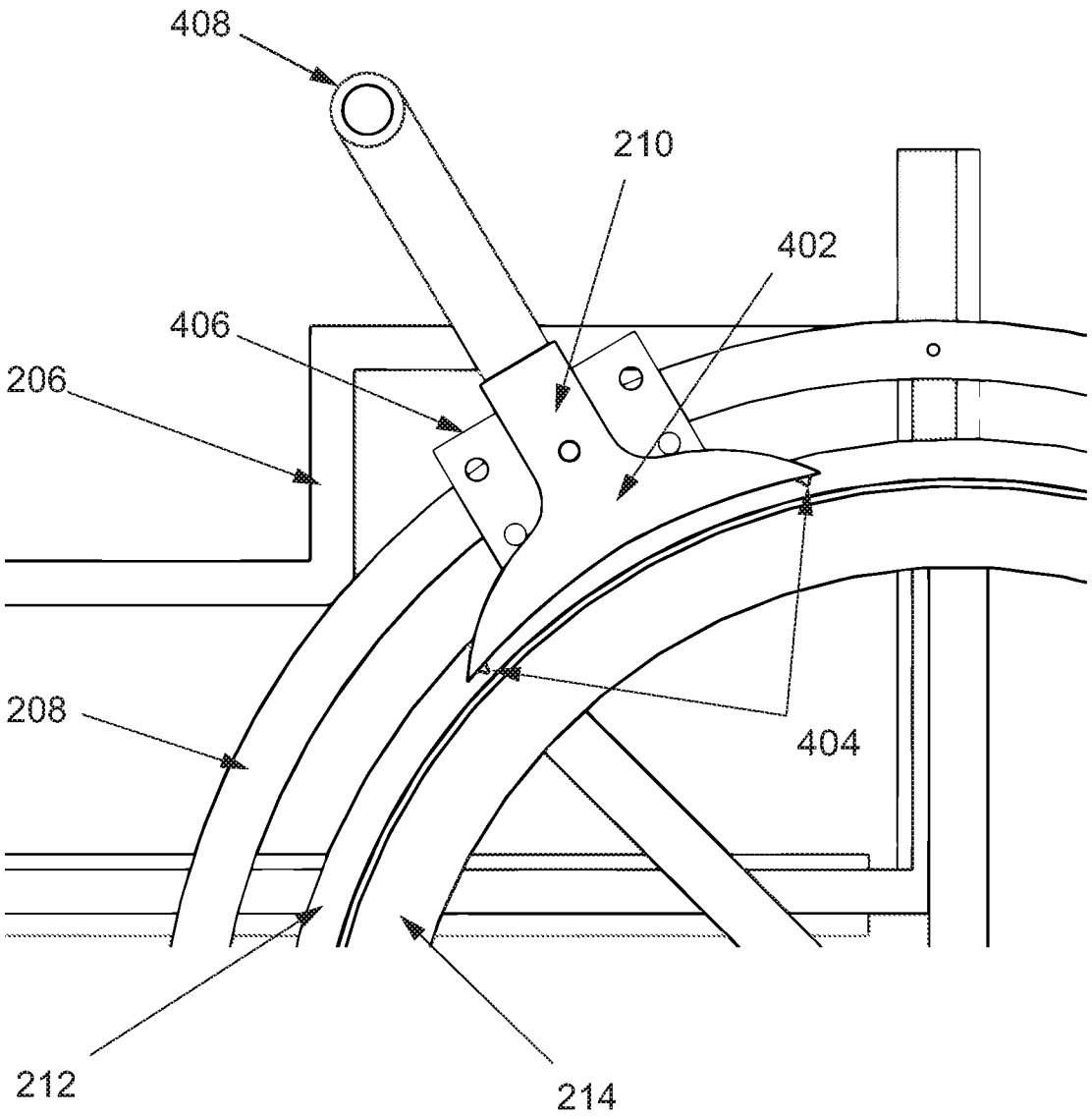
FIG. 4 is a side detail view of car assembly of the wheelchair with ratchet/pawl drive system in accordance with an embodiment of the invention.

FIG. 4 is a side detail view of car assembly of the wheelchair with ratchet/pawl drive system in accordance with an embodiment of the invention. The car assembly 210 is comprised of a ratchet/pawl drive system that consists of an adjustable and/or moveable handle assembly 408, drive plate 402 with two pawls at the distal ends of the drive plate. Persons skilled in the art will understand that the adjustable and/or moveable handle assembly may consist of various adjustable handle and lever mechanisms known and understood in the art. The adjustable and/or moveable handle assembly serves as a ratcheting lever to engage the car assembly 210 of ratchet/pawl drive system with the drive wheel 214. The dual pawls 404 are mirror images of each other. In one embodiment of the invention, the dual pawls 404 are simple teeth which directly engage with the drive wheel 214. The drive wheel 214 with dual opposing 'drop-door' pawl slots receives the pawls 404. In this simple embodiment, the dual pawls 404 may engage with the drive wheel 214 so as to move the wheelchair wheel when force is applied through the adjustable and/or moveable handle assembly 408 to the car assembly 210. Persons skilled in the art will understand that the components may be constructed out of strong but lightweight metals such as, but not limited to, aluminum, stainless steel or other metal alloys known and appreciated in the art. Since the square head of the pawl strikes the flat 'drop-door' pawl slots, there is no friction wear caused by the drive pawl handle. Both surfaces may be coated in friction-reducing material such as, but not limited to, a polytetrafluoroethylene (PTFE) coating, so as to diminish noise. It is understood that the ratchet/pawl and brake assembly may come with moveable handle assembly that may provide for increased leverage when undergoing particularly strenuous activity or to minimize the chair width for narrow hallways and doorways.

Persons having skill in the art will recognize that use of the invention is designed to be simple. To propel the wheelchair 100 forward with the ratchet/pawl drive, a user simply moves the forward-neutral-reverse lever 105 into the forward position, engages the ratchet/pawl drive with a drive wheel and pushes the drive handles of the adjustable and/or moveable handle assembly 408. The ratcheting action allows a user to push forward on the drive handles to start the forward propulsion. In forward gear pushing the drive handles forward moves the wheelchair forward. The drive handles on the reverse motion move freely so that the 'rowing' cycle can start over again. To propel the wheelchair backward with the ratchet/pawl drive, a user simply moves a forward-neutral-reverse lever into the reverse position, engages the ratchet/pawl drive with a drive wheel and pulls the set of the drive handles of the adjustable and/or moveable handle assembly 408. The ratcheting action allows a user to pull backwards on the drive handles to start the reverse propulsion. In reverse gear, pulling the drive handles back moves the wheelchair backwards. The drive handles on the forward motion move freely so that the 'rowing' cycle can start over again. Because of the symmetrical nature of the drive system in some embodiments, a user may apply differing amounts of force to each handle of the car assemblies so as to steer the wheelchair.

The car assembly 210 is designed to move along the car guide track 208 smoothly and with minimal friction. In embodiments of the invention, the car assembly 210 is movably attached to the mounting bracket 206 and may ride on a mechanism such as, but not limited to, internal upper and lower nylon cage flat needle bearings or custom roller bearings as it moves back and forth along the car guide track 208. Persons having skill in the art will readily appreciate that there are numerous other means to movably attach the ratchet/pawl and brake assembly to the mounting bracket 206 and allow it to move along the car guide track 208.

Figure 5:
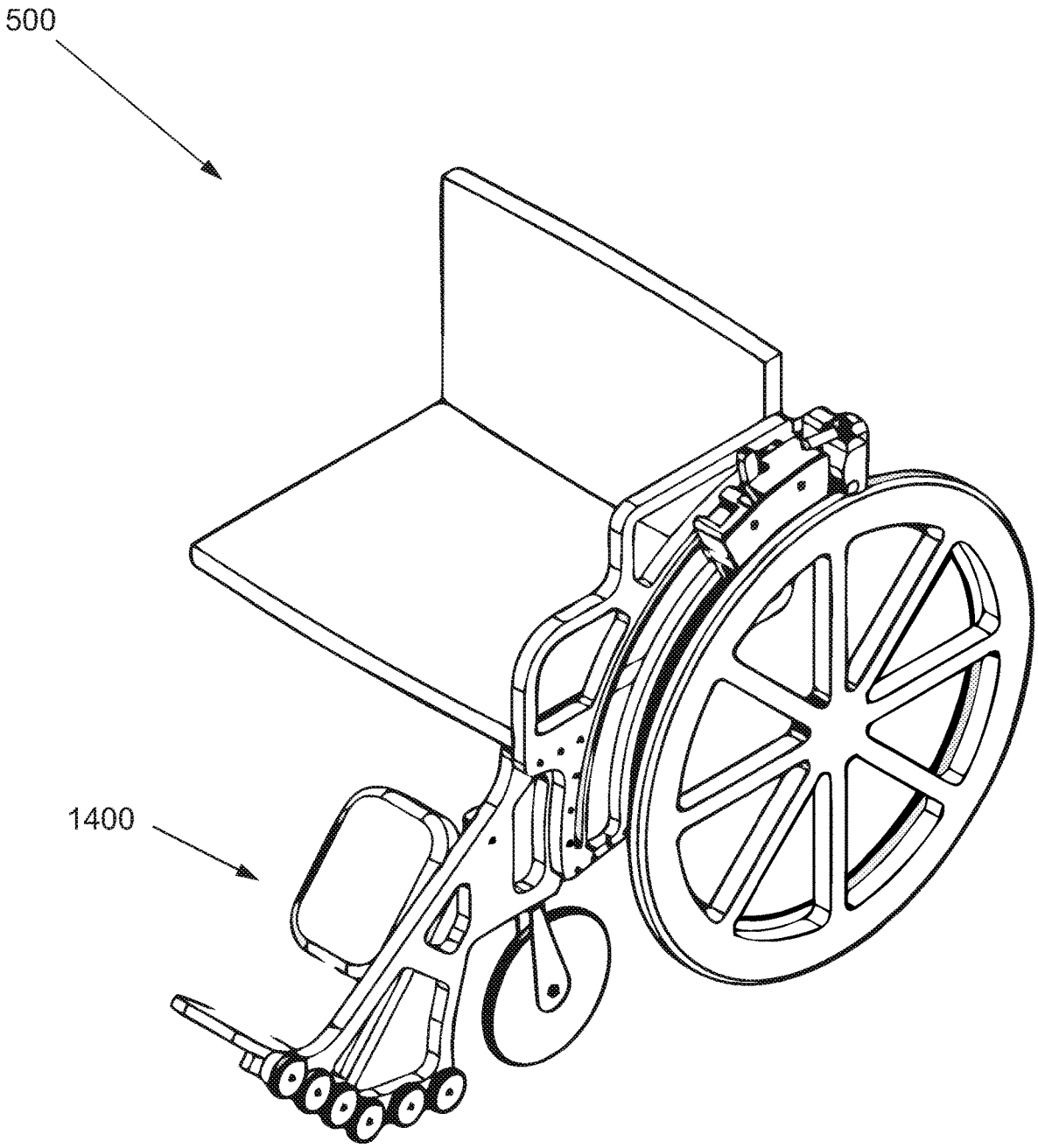
FIG. 5 is a perspective view of the left side of the wheelchair with ratchet/pawl drive system in accordance with an alternative embodiment of the invention.

FIG. 5 is a perspective view of the left side of the wheelchair with ratchet/pawl drive system in accordance with an embodiment of the invention. Persons skilled in the art will understand that, in this and the following views, that the right-side view may not show components included on the left side, but it is assumed to include components mirroring those on the left. The wheelchair 500 includes a front wheel curb climber assembly 1400 which may be included in the wheelchair. Persons skilled in the art will understand that components known to exist in standard wheelchairs, yet not depicted in this or the following figures are understood to readily integrate with embodiments of the present invention. Additionally, persons having skill in the art will understand that components of the exemplary wheelchair with ratchet/pawl drive system may be used on one side of a wheelchair or both sides depending on user need. Finally, persons skilled in the art will appreciate that the components depicted in this and the following illustrations may be assembled into a new and improved wheelchair or sold as an aftermarket retrofit kit for standard wheelchairs with components and attachment equipment such as, but not limited to instructions and fastening and/or connecting materials included.

Figure 6:
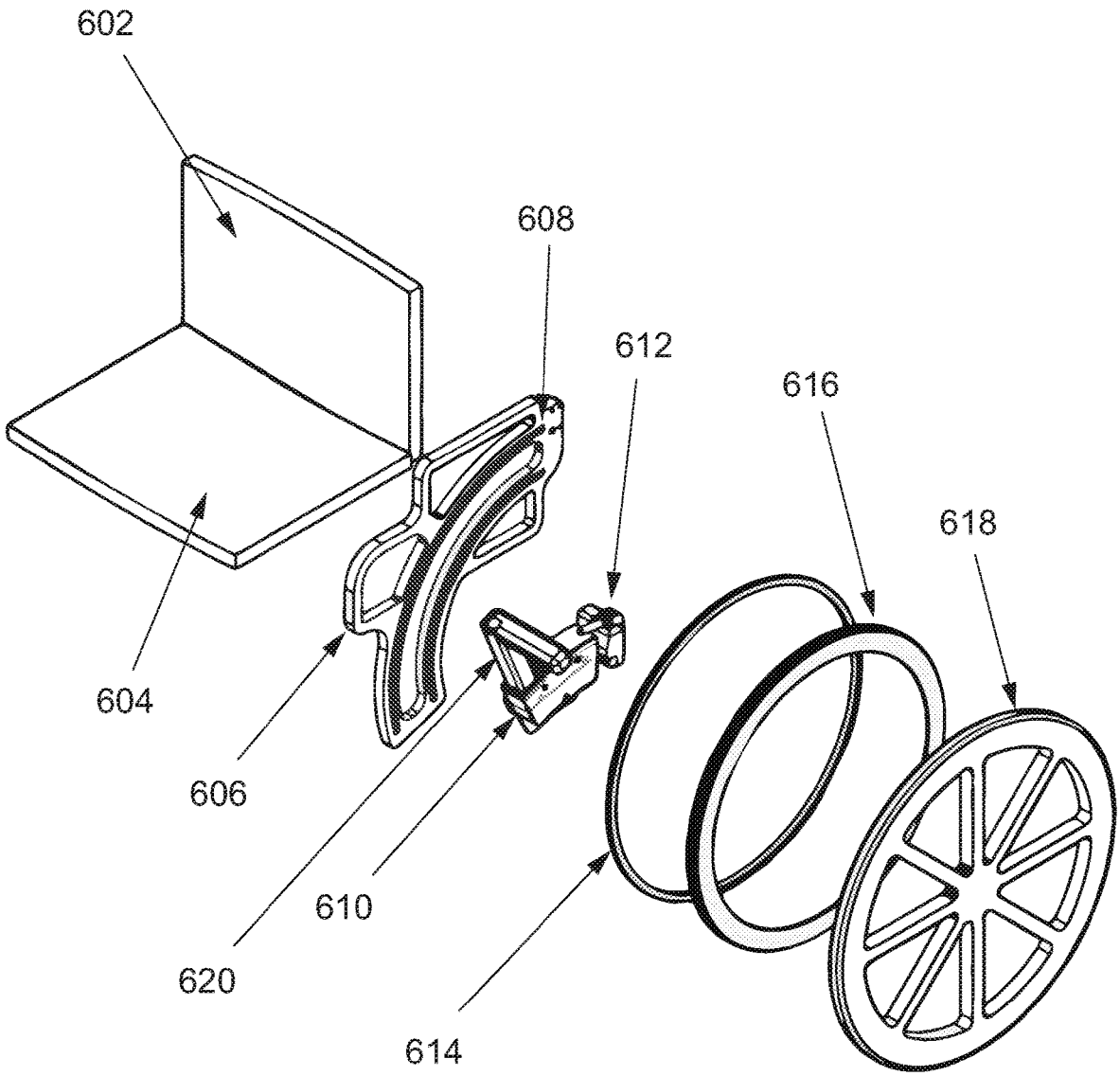
FIG. 6 is a perspective exploded view of the left side of the wheelchair with ratchet/pawl drive system in accordance with an alternative embodiment of the invention.

FIG. 6 is a perspective exploded view of the left side of the wheelchair with ratchet/pawl drive system in accordance with an alternative embodiment of the invention. The primary components comprise a seat back 602 seat bottom 604 mounting bracket 606 car guide track 608 car assembly 610 dual brake assembly 612 drive wheel sprocket 614 drive wheel 616 and wheelchair wheel 618.

In some embodiments of the invention, the seat assembly may be a standard fold-up wheelchair seat. Persons skilled in the art, though, will understand that a seat back 602 and seat bottom 604 may connect the sides of a wheelchair frame to form a single, rigid unit. In alternative embodiments of the invention, the seat back 602 and seat bottom 604 may be customizable to accommodate persons of varying heights, weights and body sizes.

In some embodiments of the invention, each mounting bracket 606 may attach to a wheelchair frame on opposite sides where the seat back 602 and seat bottom 604 connect. Each mounting bracket 606 may attach by known means such as, but not limited to, standard bolts or welding. The mounting brackets 606 may serve to provide additional rigidity and stability for a wheelchair frame. Each mounting bracket 606 may come with a car guide track 608 capable of accommodating the car assembly 610. Persons skilled in the art will appreciate that the mounting brackets 606 may be fabricated from numerous materials such as, but not limited to, metals and plastics. The mounting brackets 606 may assume different shapes and confirmations so as to easily integrate with various wheelchair frames known and appreciated in the art. It is understood that the car assembly may come with a an adjustable and/or moveable handle assembly 620 that may provide for increased leverage when undergoing particularly strenuous activity or to minimize the chair width for narrow hallways and doorways.

Embodiments of the invention include a car assembly 610 that is movably connected and/or engaged with the mounting bracket 606, more particularly the car guide track 608. The car assembly 610 may also be movably connected and/or engaged with a drive wheel sprocket 614 which covers the perimeter of a drive wheel 616. In other embodiments of the invention, the car assembly 610 may be larger with additional forward gears added, such as, but not limited to, a second, third and fourth gear. In such other embodiments of the invention, the higher gear ratios will allow the wheelchair to attain speeds closer to what a bicycle may attain. In yet other embodiments of the invention, the drive wheel sprocket 614 and drive wheel 616 may be a single integrated unit. Persons skilled in the art will readily appreciate how such a single integrated unit may be created such as, but not limited to, casting or molding a single unit. In embodiments of the invention, the drive wheel 616 is attached to the wheelchair wheel 618 so as to create a single axis of rotation, the axis of which may be used to create a hub/axle which may rotatably connect to a standard wheelchair frame or to the mounting bracket 606.

The wheelchair wheel 618 as shown may movably connect to a wheelchair frame by numerous means known and readily understood by persons skilled in the art. In embodiments of the invention, the wheelchair wheels connect to a wheelchair frame by a hub and bearing mechanism similar to a standard bicycle tire. In other embodiments, the wheelchair wheels may rotatably attach to the mounting bracket 606 so as to create an integrated frame unit with the seat back 602 and seat bottom 604.

Figure 7:
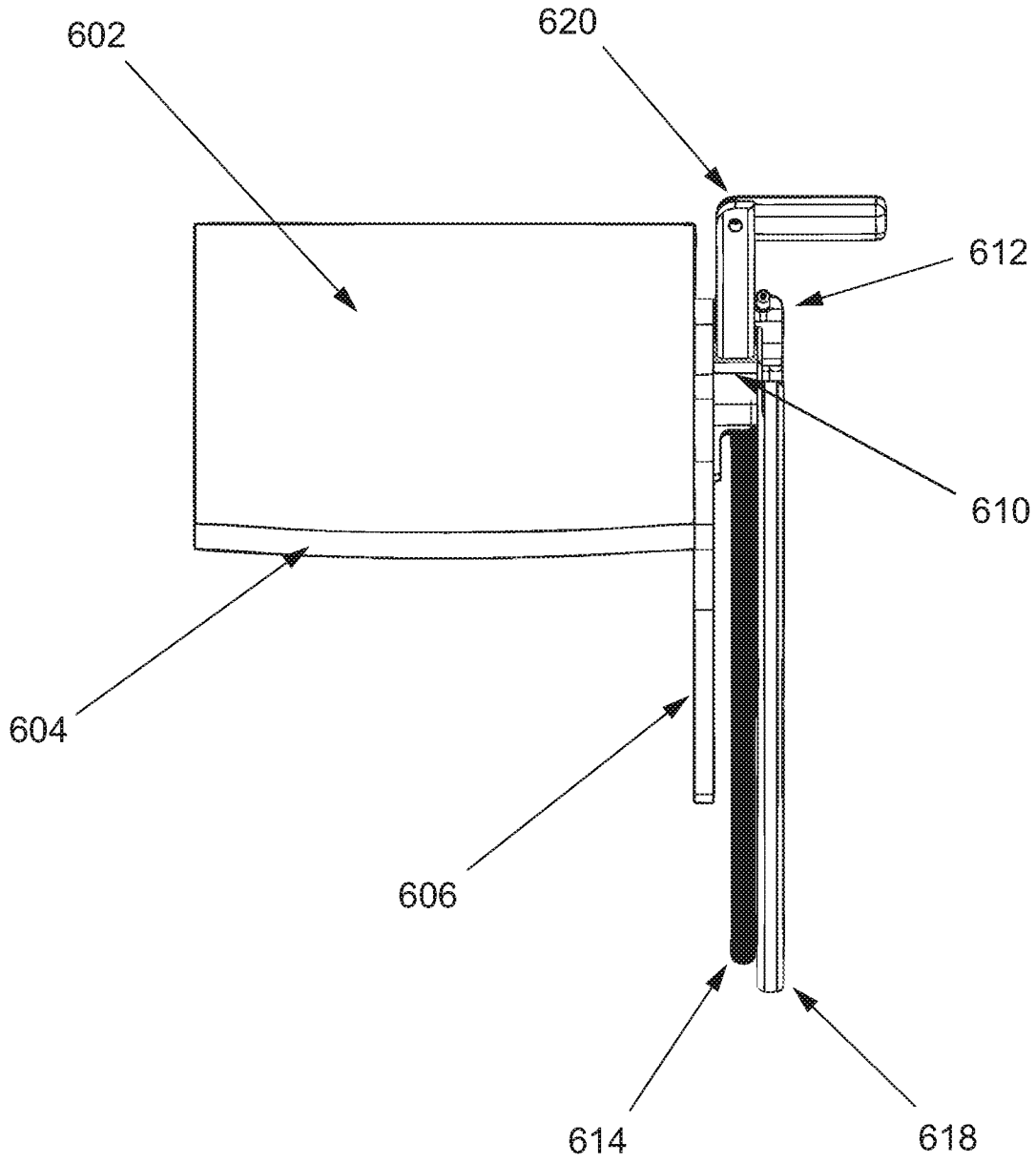
FIG. 7 is a front view of the left side of a wheelchair employing the ratchet/pawl drive for wheelchairs in accordance with an alternative embodiment of the invention.

FIG. 7 is a front view of the left side of a wheelchair employing the ratchet/pawl drive for wheelchairs in accordance with an alternative embodiment of the invention. In some embodiments of the invention, each mounting bracket 606 may attach to a wheelchair frame on opposite sides where the seat back 602 and seat bottom 604 connect. In other embodiments, the mounting bracket 606 may serve as part of the frame itself. Each mounting bracket 606 may attach by known means such as, but not limited to, standard bolts or welding. The mounting brackets 606 may serve to provide additional rigidity and stability for a wheelchair frame. Each mounting bracket 606 is capable of accommodating the car assembly 610. Persons skilled in the art will appreciate that the mounting brackets 606 may be fabricated from numerous materials such as, but not limited to, metals and plastics. The mounting brackets 606 may assume different shapes and confirmations so as to easily integrate with various wheelchair frames known and appreciated in the art. Persons having skill in the art will readily appreciate that the mounting frame 606 may connect to the frame and seat components of a standard wheelchair by standard means such as, but not limited to, screws, rivets bolts, and/or welds.

Figure 8:
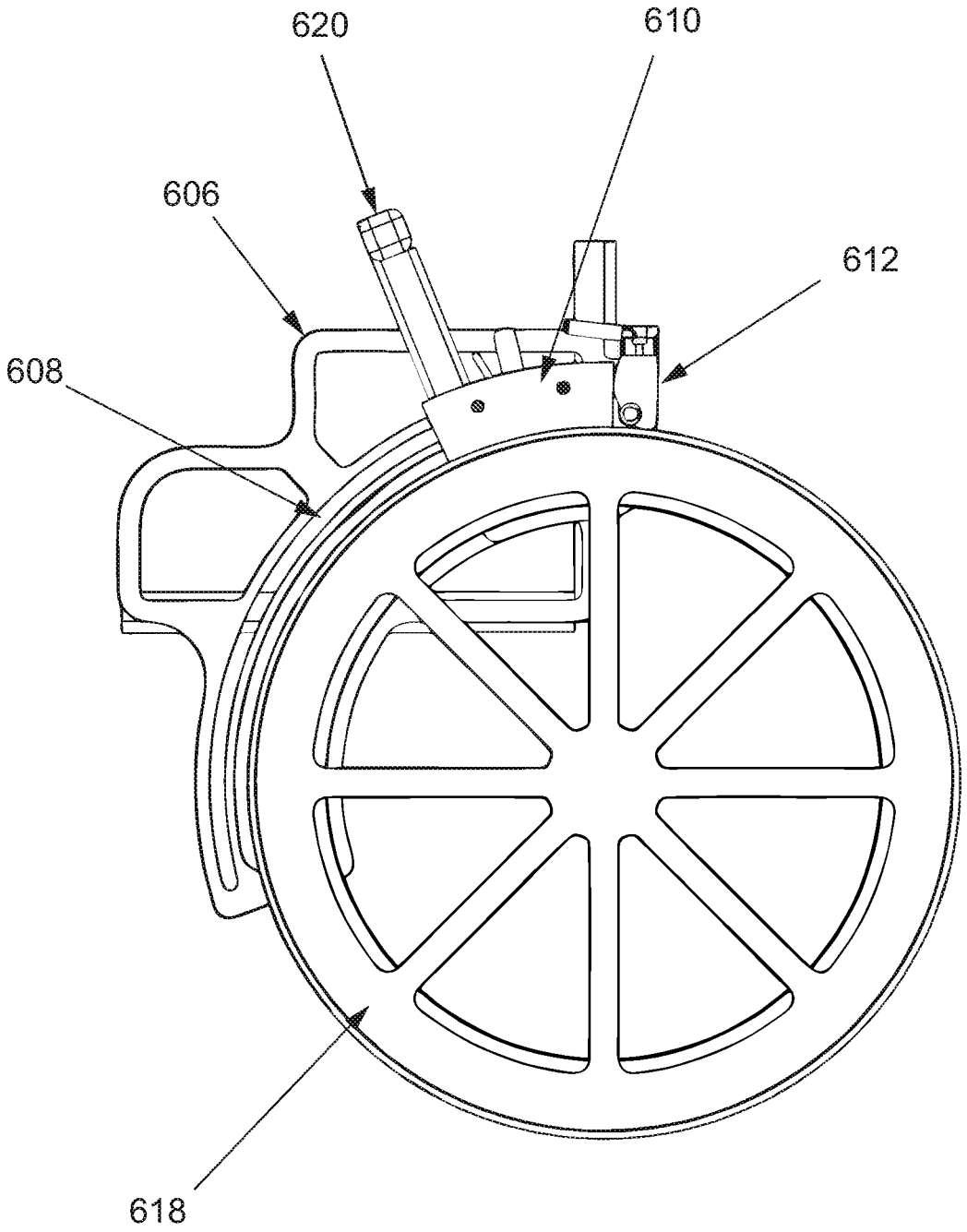
FIG. 8 is a side view of the of the left side of the wheelchair with ratchet/pawl drive system in accordance with an embodiment of the invention

FIG. 8 is a side view of the left side of the wheelchair with ratchet/pawl drive system in accordance with an embodiment of the invention. In an embodiment of the invention, the car assembly 610 is movably attached to the mounting bracket 606 and travels along a car guide track 608 which may be integrated into the mounting bracket 606. Movement of the car assembly 610 along the car guide track 608 is what ultimately creates the force to turn the wheelchair wheel 618. Persons skilled in the art will understand that a wheelchair wheel 618 may movably connect to a wheelchair frame known and readily understood by persons skilled in the art. Such a connection generally includes a hub and bearing assembly, but other connections may include an axle assembly. In one embodiment of the invention, eight bolts may secure the drive wheel sprocket 614 to the wheelchair wheel 618. Persons skilled in the art will also understand that in various embodiments of the invention, multiple bolts and screws may secure each mounting bracket 606 to a wheelchair frame or to the seat back 602 and seat bottom 604 to create a simpler, integrated, rigid frame.

The car assembly 610 is designed to move along the guide track smoothly and with minimal friction. In embodiments of the invention, the car assembly 610 is movably attached to the mounting bracket 606 and may ride on a mechanism such as, but not limited to, internal upper and lower nylon cage flat needle bearings or custom roller bearings as it moves back and forth along the guide track 608. Persons having skill in the art will readily appreciate that there are numerous other means to movably attach the car assembly to the mounting bracket 606 and allow it to move along the guide track 608.

Figure 9:
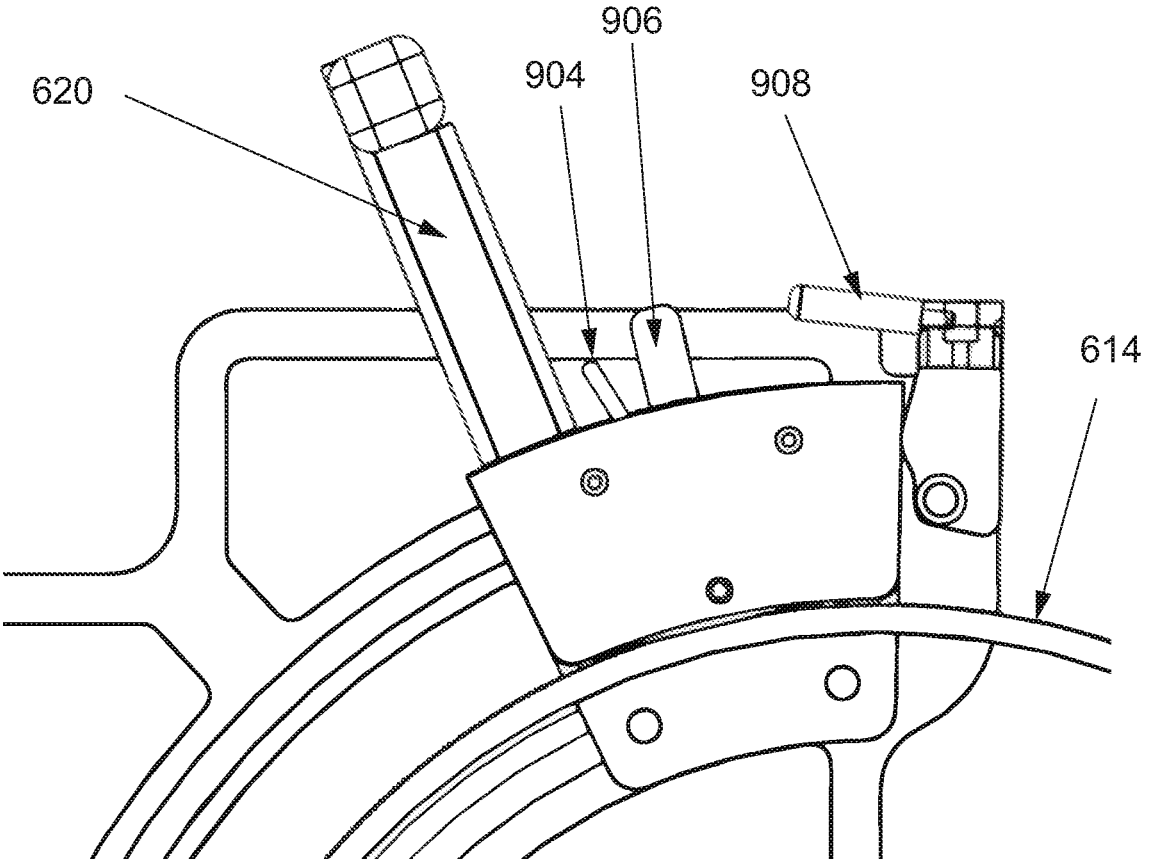
FIG. 9 is a side detail view of the left side of the wheelchair with ratchet/pawl drive system in accordance with an embodiment of the invention.

FIG. 9 is a side detail view of the left side of the wheelchair with ratchet/pawl drive system in accordance with an embodiment of the invention. In an embodiment of the invention, the car assembly includes an adjustable and/or moveable handle assembly 620 which includes a handle and a lever for a user to push or pull in order to move the wheelchair. Persons skilled in the art will understand that the adjustable and/or moveable handle assembly 620 may consist of various adjustable handle and lever mechanisms known and understood in the art. The adjustable and/or moveable handle assembly serves as a ratcheting lever to engage the car assembly 210 of ratchet/pawl drive system with the drive wheel sprocket 614. The car assembly also includes a hill brake lever 904 and a forward-neutral-reverse lever 906. In an embodiment of the invention, the hill brake lever 904 engages when the wheelchair is in forward gear and serves as a safety feature not available on any existing wheelchair. With the hill brake lever 904, the wheelchair cannot roll backwards because the hill brake ratchet automatically engages when the user moves the adjustable and/or moveable handle assembly 620 backwards. While moving up a hill or ramp the wheelchair will never go backwards, even if the user removes his or her hands from the adjustable and/or moveable handle assembly 620.

Figure 10:
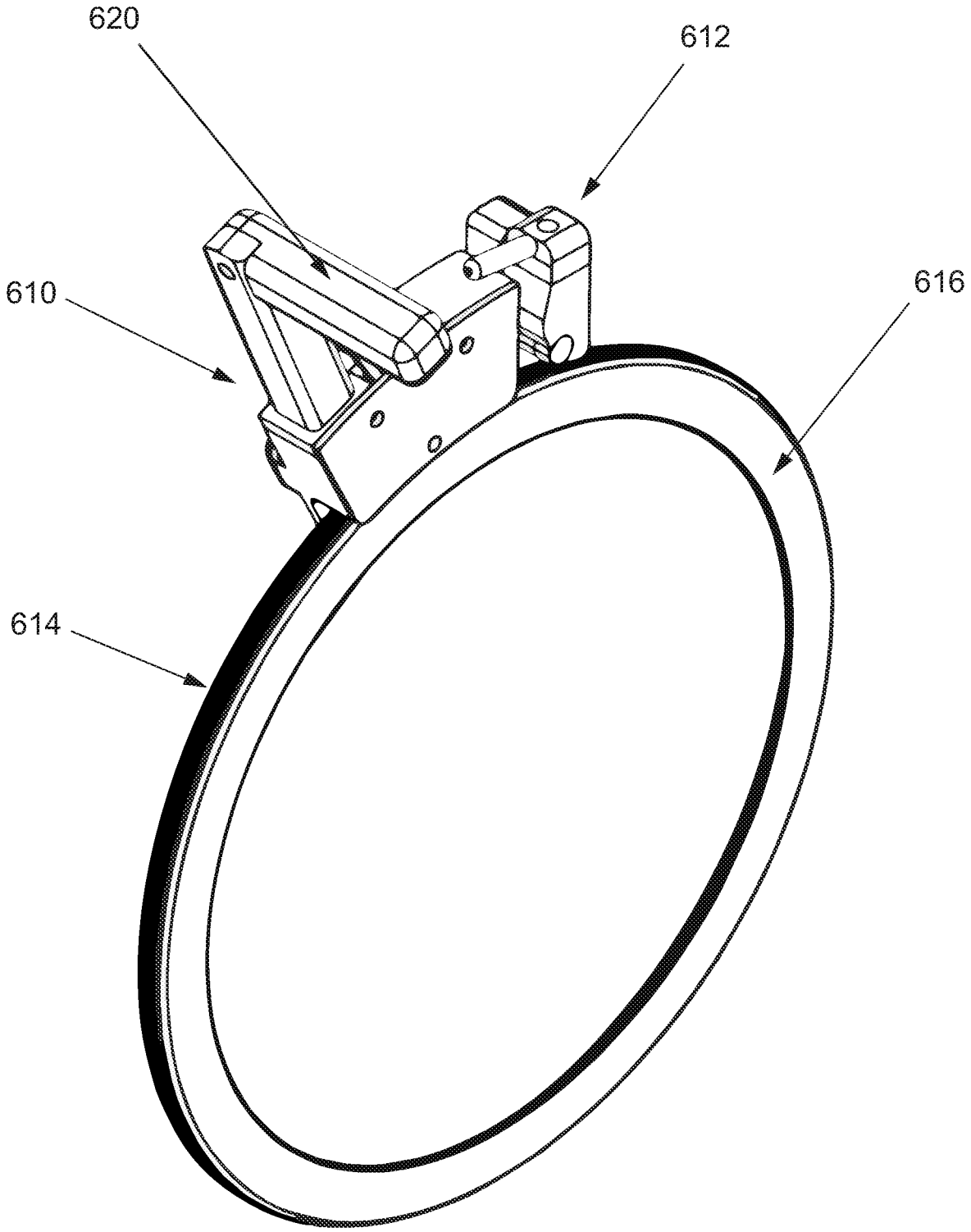
FIG. 10 is a perspective view of the car assembly and drive wheel of the wheelchair with ratchet/pawl drive system in accordance with an embodiment of the invention.

FIG. 10 is a perspective view of the car assembly and drive wheel of the wheelchair with ratchet/pawl drive system in accordance with an embodiment of the invention. In this view, the car assembly 610 is movably connected and/or engaged with a drive wheel sprocket 614 which covers the perimeter of a drive wheel 616. Also shown is the dual brake assembly 612. The dual brake assembly 612 components are also mirror images of each other and may be movably connected directly to the mounting brackets 606 by means known by persons skilled in the art such as, but not limited to, various bolt mechanisms. In some embodiments, the dual brake assembly 612 may be activated when the handles of the adjustable and/or moveable handle assembly 620 are pulled back, which may also disengage the ratchet/pawl drive mechanism. In other embodiments, the dual brake assemblies have their own levers and allow the users to manually engage the brake surface against the drive wheel so as to slow or stop the wheelchair. The pulling back of the car assembly may engage the brake assembly against the drive wheel or the wheelchair wheel itself. If only partial pull-back pressure is put on the drive handles of the adjustable and/or moveable handle assembly 620, the wheelchair will slow. If full pull-back pressure is exerted on the drive handles of the adjustable and/or moveable handle assembly 620, the wheelchair will quickly come to a full stop. The dual brake assembly cam 612 is forced against the rubber tire on the drive wheel 616 or the wheelchair wheel 618 when the drive handles of the adjustable and/or moveable handle assembly 620 are pulled all the way back, thereby causing the wheelchair to slow/stop. Persons skilled in the art will appreciate that alternative means of providing a dual brake system may be integrated into the wheelchair with ratchet/pawl drive system such as, but not limited to, brake levers used in standard wheelchairs.

The car assembly 610 may include one or more face plates 1102 to protect the components housed within the car assembly. Such face plates 1102 may serve to form an outer housing.

Figure 11:
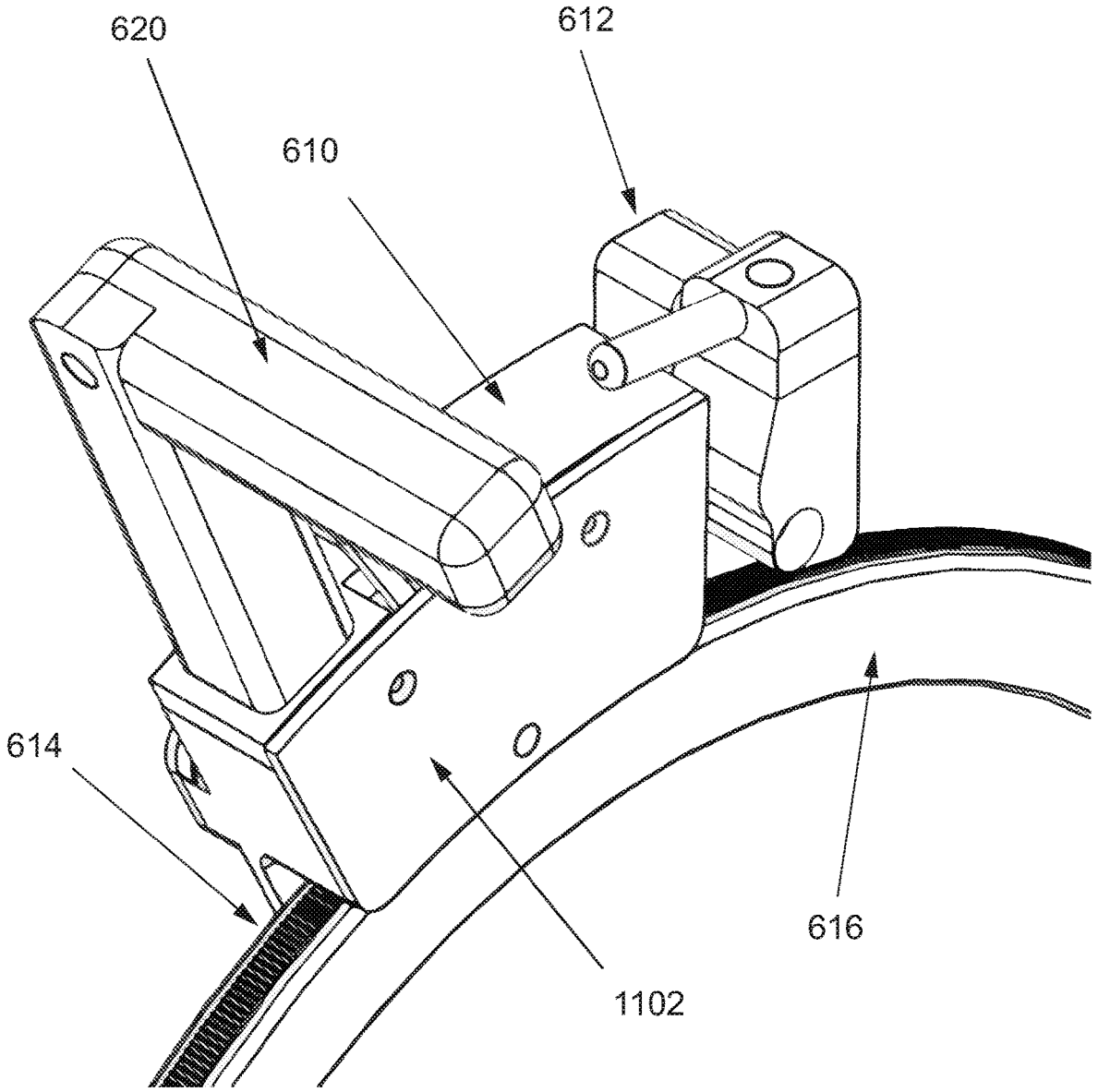
FIG. 11 is a perspective detail view of the car assembly and drive wheel of the wheelchair with ratchet/pawl drive system in accordance with an embodiment of the invention.

FIG. 11 is a perspective detail view of the car assembly and drive wheel of the wheelchair with ratchet/pawl drive system in accordance with an embodiment of the invention. In this view, the car assembly 610 is movably connected and/or engaged with a drive wheel sprocket 614 which covers the perimeter of a drive wheel 616. Also shown is the dual brake assembly 612. The car assembly 610 may include one or more face plates 1102 to protect the components housed within the car assembly. The car assembly 612 and face plates 1102 serve not only to protect the gearing inside the car assembly 612, but also serves to eliminate any serious contact hazards to humans. Unlike bicycles, there are no chains or sharp gears that can easily snag clothing or limbs.

Figure 12:
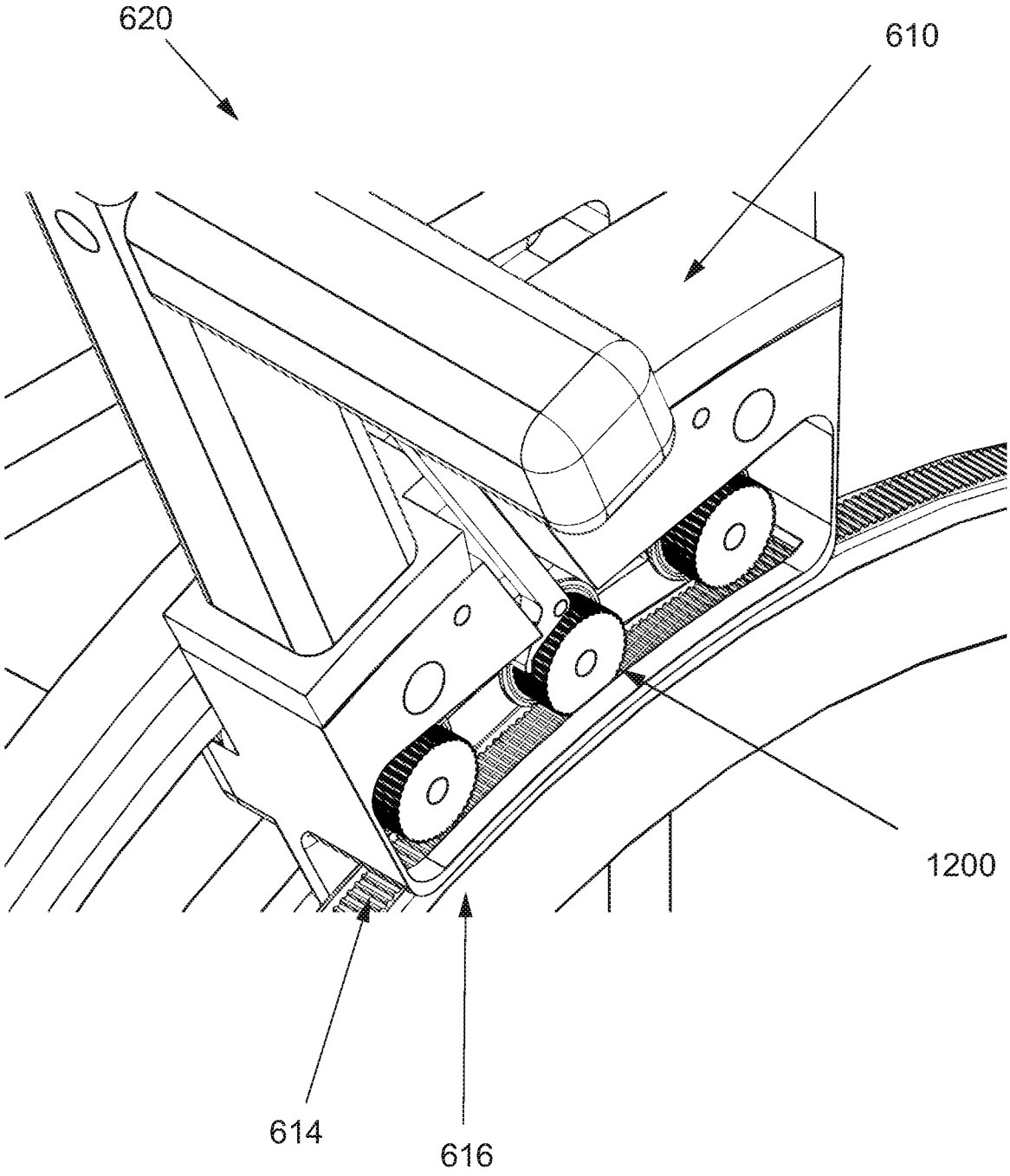
FIG. 12 is a perspective cutaway view of the car assembly of the wheelchair with ratchet/pawl drive in accordance with an embodiment of the invention.

FIG. 12 is a perspective cutaway view of the car assembly of the wheelchair with ratchet/pawl drive in accordance with an embodiment of the invention. In this view, the car assembly 610 is movably connected and/or engaged with a drive wheel sprocket 614 which covers the perimeter of a drive wheel 616. In this view, a face plate has been removed to show the car assembly's inner components, namely a ratchet/pawl drive 1200, engaged and interrelated with the drive wheel sprocket 614 and drive wheel 616.

Figure 13:
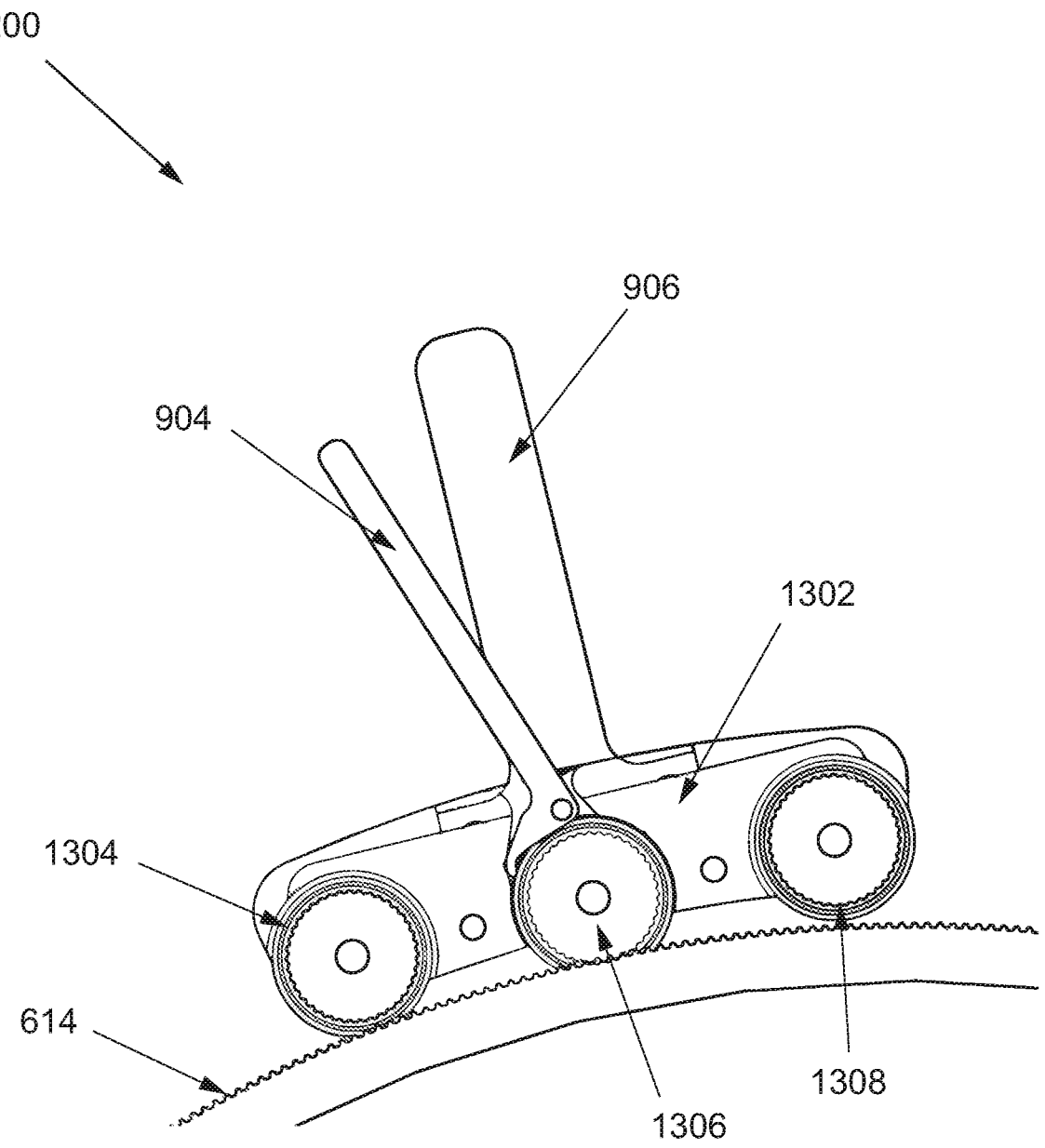
FIG. 13 is a detail view of the ratchet/pawl drive of the car assembly of the wheelchair with ratchet/pawl drive in accordance with an embodiment of the invention.

FIG. 13 is a detail view of the ratchet/pawl drive 1200 of the car assembly of the wheelchair with ratchet/pawl drive in accordance with an embodiment of the invention. In one embodiment of the invention, the ratchet/pawl drive includes a car gear assembly block 1302, a hill brake lever 904, a forward-neutral-reverse lever 906, a forward sprocket 1304, a hill brake sprocket 1306, and a reverse sprocket 1308. The forward-neutral-reverse lever may engage the forward sprocket or the reverse sprocket depending on the position a user selects. Persons skilled in the art will readily appreciate that there are numerous means of engaging the ratchet/pawl drive 1200 to the drive wheel sprocket 614 by using a forward-neutral-reverse lever 906 mechanism. The hill brake sprocket 1306 is always engaged to the drive wheel sprocket 614. The hill brake sprocket 1306 may rotate both clockwise and counter clockwise; except when the hill brake 904 is engaged, at which time it can only move clockwise, thereby eliminating the possibility of the wheelchair going backwards down a hill, ramp or incline. When the forward sprocket 1304 is engaged with the drive wheel sprocket 614, the wheel chair will only move forward. When the reverse sprocket 1308 is engaged with the drive wheel sprocket 614, the wheelchair will only move in reverse. When neither the forward sprocket 1304 nor reverse sprocket 1308 are engaged with the drive wheel sprocket, the wheelchair is in neutral with only the hill brake sprocket 1306 engaged. Persons skilled in the art will understand that the forward sprocket 1304, the hill brake sprocket 1306 and the reverse sprocket 1308 may be fashioned from, but is not limited to, a ratcheting means such as a star ratchet and spring means known in the art. Other ratcheting gear and pawl systems are also to be considered as within the scope of the present invention.

Persons having skill in the art will recognize that use of the invention is designed to be simple. To propel the wheelchair 500 forward with the ratchet/pawl drive, a user simply moves the forward-neutral-reverse lever 906 into the forward position, engages the ratchet/pawl drive with a drive wheel and pushes the drive handles of the adjustable and/or moveable handle assembly 620. The ratcheting action allows a user to push forward on the drive handles to start the forward propulsion. In forward gear pushing the drive handles forward moves the wheelchair forward. The drive handles on the reverse motion move freely so that the 'rowing' cycle can start over again. To propel the wheelchair backward with the ratchet/pawl drive, a user simply moves a forward-neutral-reverse lever into the reverse position, engages the ratchet/pawl drive with a drive wheel and pulls the set of the drive handles of the adjustable and/or moveable handle assembly 620. The ratcheting action allows a user to pull backwards on the drive handles to start the reverse propulsion. In reverse gear, pulling the drive handles back moves the wheelchair backwards. The drive handles on the forward motion move freely so that the 'rowing' cycle can start over again. Because of the symmetrical nature of the drive system in some embodiments, a user may apply differing amounts of force to each handle of the car assemblies so as to steer the wheelchair.

Figure 14:
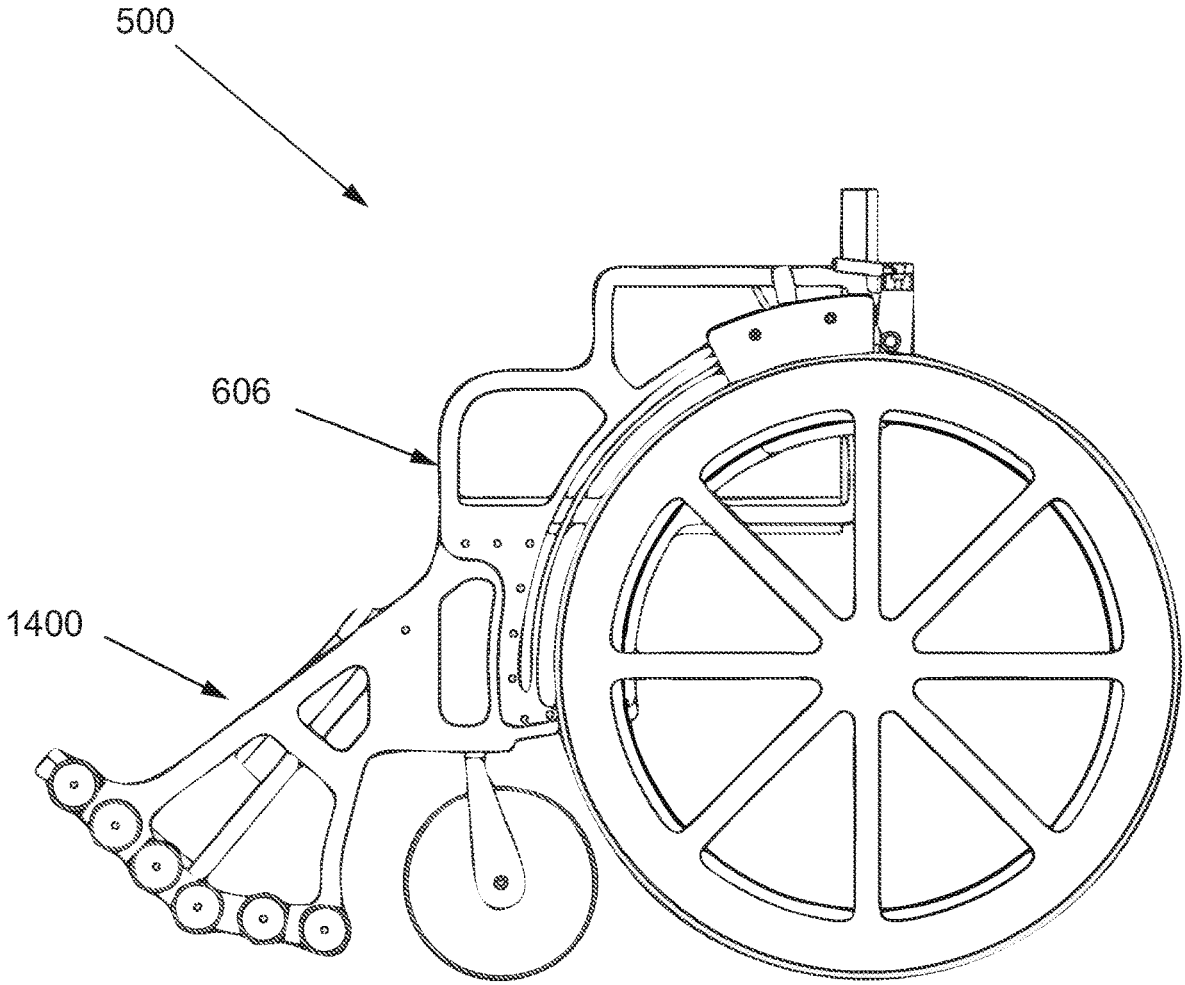
FIG. 14 is a side view of a wheelchair employing the exemplary ratchet/pawl drive and front wheel with curb climber assembly in accordance with an embodiment of the invention.

FIG. 14 is a side view of a wheelchair employing the exemplary ratchet/pawl drive and curb climber assembly in accordance with an embodiment of the invention. In various embodiments of the invention, the front wheel with curb climber assembly 1400 may attach to the mounting bracket 606 or to a standard wheelchair frame. Persons having skill in the art will understand that there are numerous ways to attach the curb climber assembly 1400 to either a wheelchair frame or to the mounting bracket such as, but not limited to, welds, rivets or bolts.

Figure 15:
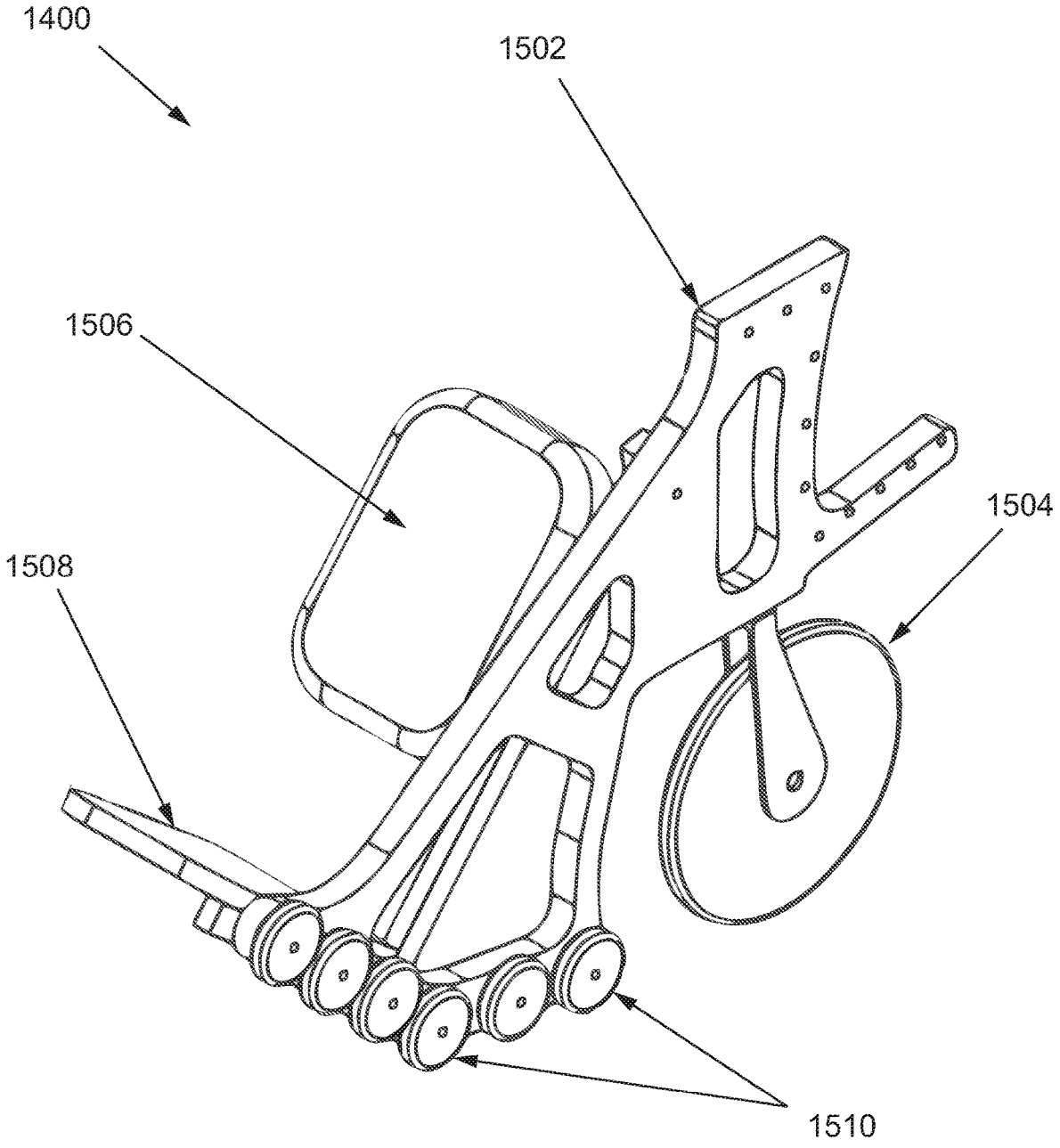
FIG. 15 is a perspective view of the front wheel with curb climber assembly of the wheelchair with ratchet/pawl drive in accordance with an embodiment of the invention.

FIG. 15 is a perspective view of the front wheel with curb climber assembly of the wheelchair with ratchet/pawl drive in accordance with an embodiment of the invention. In one embodiment of the invention, the front wheel with curb climber assembly 1400 includes a curb climber frame 1502, a chair front caster assembly 1504, a leg cushion 1506, a foot rest 1508, an adjustable foot and leg support arm 1510, and a curb climber rollers assembly 1512. The curb climber roller assembly wheels 1512 are small-diameter wheels that may roll up a curb or steep incline easier than solely a front caster wheel known in the art. In one embodiment of the invention seven small wheels are used in each assembly used on each side of a wheelchair, but alternative embodiments may have fewer or more or wheels of varying sizes, depending on the application. Typical curbs vary between four and eight inches in height. It is therefore an object of the curb climber to be able to climb a curb between four and eight inches. While the curb climber assembly is designed to be installed on any wheelchair, preferred embodiments are designed to work with the wheelchair drive system described herein, because it necessitates that there be a hill brake engaged at all times in order to stop the wheelchair from rolling backwards after backing off on the drive handles 610 after each push forwards. The drive system wheelchair and the curb climber will be sold separately since some will only be using it only for office or home while others will be needing the added curb climber feature to surmount the numerous obstacles afforded in everyday life. While the curb climber was designed specifically to surmount curbs, it works equally as well coming off of a curb (up to 8"). The user has full control to move slowly down curbs and/or inclines through the use of the drive handles of the adjustable and/or moveable handle assembly.

Figure 16:
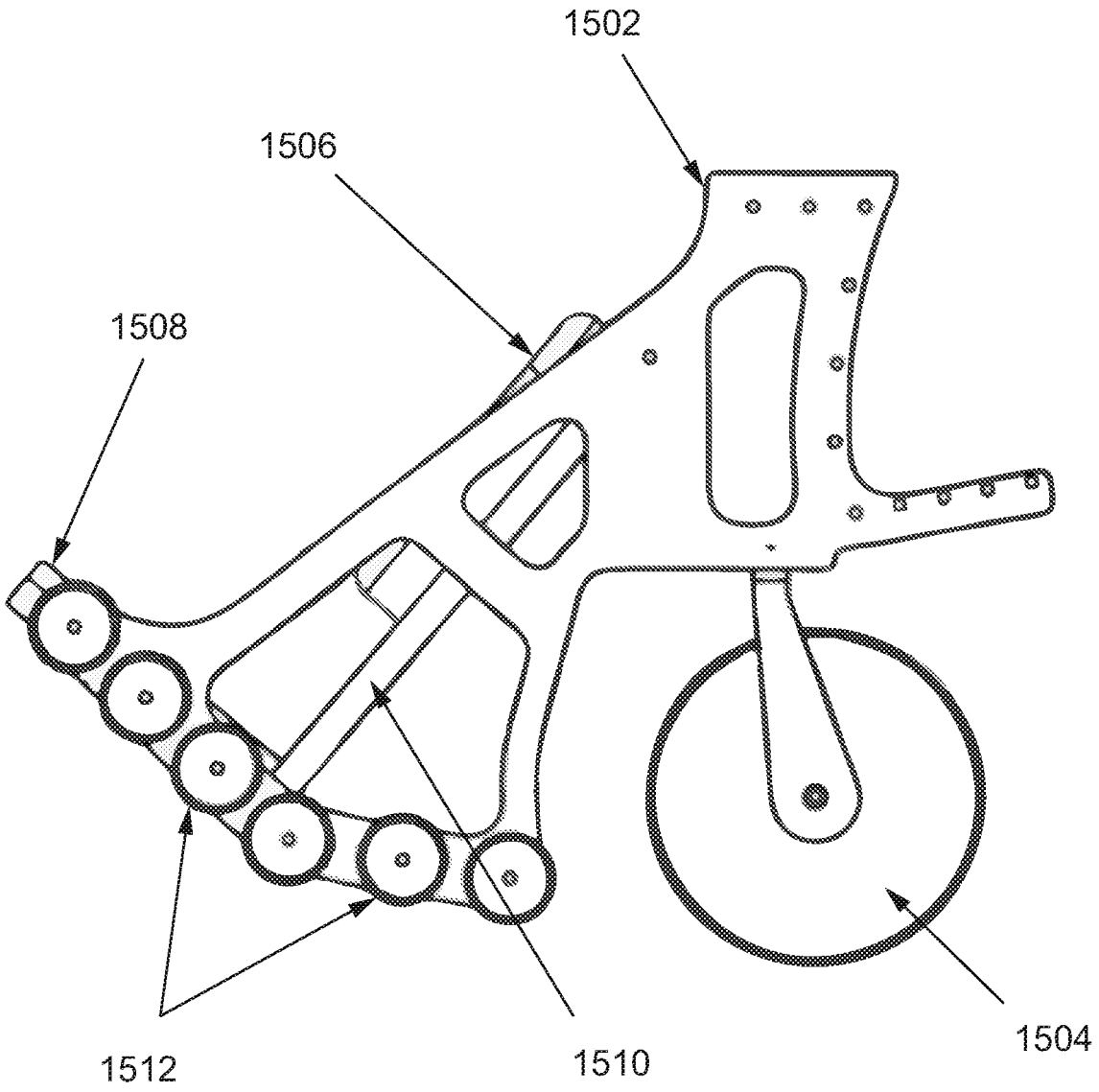
FIG. 16 is a side detail view of the front wheel with curb climber assembly of the wheelchair with ratchet/pawl drive in accordance with an embodiment of the invention.

FIG. 16 is a side detail view of the front wheel with curb climber assembly of the wheelchair with ratchet/pawl drive in accordance with an embodiment of the invention. In one embodiment of the invention, the front wheel with curb climber assembly 1400 includes a curb climber frame 1502, a chair front caster assembly 1504, a leg cushion 1506, a foot rest 1508, an adjustable foot and leg support arm 1510, and a curb climber roller assembly 1512. The curb climber roller assembly 1512 includes a plurality of wheels that are small-diameter wheels that may roll up a curb or steep incline easier than solely a front caster wheel known in the art. Persons skilled in the art will readily appreciate that there are numerous means of mounting the curb climber roller assembly 1512 to the curb climber frame 1502. In one embodiment of the invention seven small wheels are used in each assembly used on each side of a wheelchair, but alternative embodiments may have fewer or more or wheels of varying sizes, depending on the application.

Having fully described at least one embodiment of the exemplary wheelchair with ratchet/pawl drive system, other equivalent or alternative methods of implementing the wheelchair with ratchet/pawl drive system according to the present invention will be apparent to those skilled in the art. Various aspects of the invention have been described above by way of illustration, and the specific embodiments disclosed are not intended to limit the invention to the particular forms disclosed. The particular implementation of the wheelchair with ratchet/pawl drive system may vary depending upon the particular context or application. Persons having skill in the art will readily appreciate the aforementioned components may be configured to one another by various means and may not necessarily be drawn to scale. Furthermore, based on the provided drawings, persons having skill in the art will readily understand how to make and use the present invention.

By way of example, and not limitation, wheelchair with ratchet/pawl drive system described in the foregoing patent application is principally directed towards a standard wheelchair. However, the scope of the present invention may be directed to lightweight racing versions that have multiple gear ratios for competitions such as the Paralympics. The multiple gear ratio versions may also be directed toward youths who want to keep up with their peers. Similar techniques may instead be applied to all-terrain versions and a battery assisted variant, which implementations of the present invention are also contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Although specific features of the invention are shown in some drawings and not others, persons skilled in the art will understand that this is for convenience. Each feature may be combined with any or all of the other features in accordance with the invention. The words "including," "comprising," "having," and "with" as used herein are to be interpreted broadly and comprehensively and are not limited to any physical interconnection. Any such numbering and lettering in itself is not intended to and should not be taken to indicate the ordering of elements and/or steps in the claims to be added at a later date.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Any amendment presented during the prosecution of the application for this patent is not a disclaimer of any claim element presented in the description or claims to be filed. Persons skilled in the art cannot reasonably be expected to draft a claim that would literally encompass each and every equivalent.

What is claimed is:

1. A wheelchair comprising:
- a seat back;
- a seat bottom;
- a frame;
- two mounting brackets;
- two car guide tracks;
- two front wheel assemblies;
- two ratchet/pawl assemblies, each assembly including a forward sprocket, a hill brake sprocket, and a reverse sprocket;
- two brake assemblies;
- two drive wheels; and
- two wheelchair wheels.

2. The wheelchair of claim 1 wherein the seat back, the seat bottom and two mounting brackets rigidly attach to the frame.

3. The wheelchair of claim 1 wherein the two car guide tracks are integrated into the mounting brackets.

4. The wheelchair of claim 1 wherein the two front wheel assemblies attach to the two mounting brackets.

5. The wheelchair of claim 1 wherein the two front wheel assemblies each include a curb climber frame, a chair front caster assembly, a leg cushion, a foot rest, an adjustable foot and leg support arm, and a curb climber roller assembly with a plurality of wheels that are small-diameter wheels capable of rolling up a curb or step incline.

6. The wheelchair of claim 1 wherein the ratchet/pawl assemblies include two adjustable and/or moveable handle assemblies, said ratchet/pawl assemblies movably attached to the two mounting brackets so as to travel along the path of the two car guide tracks.

7. The wheelchair of claim 1 wherein the ratchet/pawl assemblies include a forward-neutral-reverse lever.

8. The wheelchair of claim 1 wherein the drive wheels are attached to the wheelchair wheels so as to create a single axis of rotation.

9. The wheelchair of claim 1 wherein the drive wheels and the wheelchair wheels rotatably attach to the frame.

10. The wheelchair of claim 1 wherein the drive wheels and the wheelchair wheels rotatably attach to the mounting brackets.

11. The wheelchair of claim 1 wherein each ratchet/pawl assembly engages with each of the drive wheels.

12. The wheelchair of claim 1 wherein the two drive wheels may include drive wheel belts which fit on the outer perimeter of the two said drive wheels and engage with the ratchet/pawl assemblies.

13. The wheelchair of claim 1 wherein the brake assemblies movably attach to the mounting brackets in such a way so as to frictionally engage with the drive wheel or wheelchair wheel when the user engages the said brake assembly.

14. A wheelchair retrofit kit comprising:
- at least one drive wheel with a drive wheel sprocket;
- at least one mounting bracket with a car guide track;
- at least one ratchet/pawl_assembly including a car gear assembly block, a forward sprocket, a hill brake sprocket, and a reverse sprocket;
- at least one forward-neutral-reverse lever;
- at least one brake assembly; and
- attachment equipment.

15. The wheelchair retrofit kit of claim 14 wherein the at least one mounting bracket with a car guide track attaches to the frame of a wheelchair.

16. The wheelchair retrofit kit of claim 14 wherein the at least one drive wheel rigidly attaches to the wheel of a standard wheelchair and rotatably attaches to an axle on either the wheelchair frame or on the at least one mounting bracket.

17. The wheelchair retrofit kit of claim 14 wherein the at least one ratchet/pawl assembly includes an adjustable and/or moveable handle assembly and a forward-neutral-reverse lever which engages the said ratchet/pawl assembly to the at least one drive wheel with a drive wheel sprocket.

18. The wheelchair retrofit kit of claim 14 wherein the at least one brake assembly movably attaches to the at least one mounting bracket in such a way so as to frictionally engage with the at least one drive wheel or wheelchair wheel when the user engages the said brake assembly.

19. A ratcheting wheelchair drive system for wheelchairs comprising:
- at least one drive wheel sprocket;
- at least one ratchet/pawl assembly including a car gear assembly block, a forward sprocket, a hill brake sprocket, and a reverse sprocket;
- at least one forward-neutral-reverse lever to engage the said at least one ratchet/pawl assembly with the said at least one drive wheel sprocket; and
- at least one brake assembly.

20. The ratcheting wheelchair drive system for wheelchairs of claim 19 wherein the at least one ratchet/pawl assembly is driven through the use of an adjustable and/or moveable handle assembly.

* * * * *